US005924589A

United States Patent [19]

Gordon

[11] Patent Number: 5,924,589

[45] Date of Patent: Jul. 20, 1999

[54] FIRE RESISTANT COMPOSITE INTERMEDIATE BULK CONTAINER

[76] Inventor: Gerald A. Gordon, 1319 Fairfield Ct., Wheeling, Ill. 60090

[21] Appl. No.: 08/897,724

[22] Filed: Jul. 21, 1997

[51] Int. Cl.[6] ..... B65D 90/22

[52] U.S. Cl. ..... 220/23.91; 220/495; 220/23.87; 220/88.1

[58] Field of Search ..... 220/23.91, 23.87, 220/23.89, 495, 88.1, 88.2, 485, 494, 23.83, 23.86, 646, 647, 668, 62.11, 62.22

[56] References Cited

U.S. PATENT DOCUMENTS

| | | | |
|---|---|---|---|
| 2,755,260 | 7/1956 | Stilbert, Jr. et al. . | |
| 3,284,216 | 11/1966 | Kaplan . | |
| 3,535,130 | 10/1970 | Webb . | |
| 3,654,190 | 4/1972 | Levine . | |
| 3,669,299 | 6/1972 | Jones et al. | 220/23.87 |
| 3,697,147 | 10/1972 | Schulte . | |
| 3,697,422 | 10/1972 | Mackie . | |
| 3,702,841 | 11/1972 | Sawko . | |
| 3,745,031 | 7/1973 | Kaplan . | |
| 3,873,477 | 3/1975 | Beck et al. . | |
| 3,914,193 | 10/1975 | Fessler et al. . | |
| 3,915,777 | 10/1975 | Kaplan . | |
| 3,992,997 | 11/1976 | McCubbin et al. . | |
| 4,035,315 | 7/1977 | Ingram . | |
| 4,099,975 | 7/1978 | Albright . | |
| 4,137,376 | 1/1979 | Clegg et al. . | |
| 4,144,385 | 3/1979 | Downing et al. . | |
| 4,276,332 | 6/1981 | Castle . | |
| 4,405,076 | 9/1983 | Lines, Jr. et al. | 220/88.1 |
| 4,909,387 | 3/1990 | Schutz | 220/23.87 |
| 5,091,243 | 2/1992 | Tolbert et al. . | |
| 5,092,024 | 3/1992 | McGarvey | 220/88.1 |
| 5,206,088 | 4/1993 | Raevsky . | |
| 5,314,027 | 5/1994 | Wood . | |
| 5,367,850 | 11/1994 | Nicholas . | |
| 5,442,884 | 8/1995 | Nicholas . | |
| 5,532,292 | 7/1996 | Wainwright et al. . | |

*Primary Examiner*—Stephen Castellano
*Attorney, Agent, or Firm*—Bullwinkel Partners, Ltd.

[57] ABSTRACT

A fire resistant composite intermediate bulk container for holding flammable liquids is provided. The composite IBC has an inner polyethylene container surrounded on at least its vertical sides by a protective metal cage. The protective metal cage is coated with an intumescent paint or other intumescent coating. When the intumescent coating is exposed to high temperatures, such as could occur during a fire, the coating swells and chars, producing an ash that insulates the metal cage, preventing it from heating up to the point where it can melt through the polyethylene container.

4 Claims, 1 Drawing Sheet

FIRE RESISTANT COMPOSITE INTERMEDIATE BULK CONTAINER

BACKGROUND

1. Field Of The Invention

This patent relates to fire resistant composite intermediate bulk containers. More particularly, this patent relates to a composite intermediate bulk container having a metal cage that has been made fire resistant by coating the surrounding metal cage with an intumescent paint or other intumescent coating.

2. Description Of The Related Art

Intermediate bulk containers (IBCs) are large industrial containers having a capacity of between 450 and 3,000 liters as defined in the Department of Transportation Hazardous Materials Regulations (between about 119 and 793 gallons), used to transport and store bulk liquids. IBCs may be made from heavy duty plastics, such as high molecular weight high density polyethylene, and can be formed into numerous shapes, including stackable cubes. A single 330 gallon IBC can replace six conventional 55 gallon drums, resulting in lower filling, dispensing, handling and storage and disposal costs.

One particular type of IBC, composite IBCs, may include in their design a metal cage, usually made of steel, that surrounds the plastic container to provide support and protection and to facilitate stacking of the composite IBCs. Composite IBCs typically include a pallet for extra strength and to allow transporting the composite IBC by forklift truck. Composite IBCs typically have a fillport located on top for filling and mixing of liquids, and a discharge valve at or near the bottom to facilitate dispensing of the contents. The inner plastic container, or bottle, may be replaced as needed, in reconditioning and reuse of the IBC.

Despite their reputation for lower cost, reliability and recyclability, composite IBCs have not been widely used for transporting flammable and combustible liquids because they have not yet been approved by appropriate fire protection agencies and insurance underwriters for use in storing such materials in "protected" warehouses (warehouses whose fire suppression systems and stacking patterns meet the requirements of Section 4.8 of NFPA-30, the Flammable and Combustible Liquids Fire Code).

Experience has shown that when composite IBCs are exposed to fire, the steel cage heats up, causing a transfer of heat from the steel cage to the plastic inner container. When this heat transfer exceeds the transfer of heat from the plastic inner container to the container's liquid contents, the temperature of the container increases. If the heat exposure from a fire is great enough, the temperature of the container along those areas where the steel cage contacts the container can increase to well above the melting point of the polyethylene, overwhelming the heat removal capability of the liquid contents, and causing failure of the container.

If failure of the inner container occurs, the flammable contents can spill out and be exposed to the fire, making it extremely difficult to extinguish the blaze. As a result of this heretofore unsolved problem, a significant market for steel cage reinforced IBCs has been foreclosed, or at least made difficult to serve.

The present invention solves this problem by coating the metal cage with an intumescent paint or other intumescent coating. When the intumescent coating is exposed to high temperatures, it swells and chars, producing a low density but coherent ash. The ash or char provides thermal insulation to the metal cage, preventing the temperature of the cage from increasing to the point where the cage will melt through the inner plastic container.

By maintaining the temperature of the inner container where it contacts the metal cage low enough so that the container does not quickly melt through, even in the presence of an intense warehouse fire, the present invention allows the survival of the composite IBC's plastic inner container for a time sufficient for alternative fire protection means (e.g., sprinklers, fire service personnel with water or foam spray fire suppression equipment) to be deployed.

While intumescent paints are known in the art, their use has been generally limited to building construction materials, double-walled storage tanks and the like. The present invention for the first time incorporates intumescent paint in the design of composite intermediate bulk containers as a means to protect composite IBCs from failure due to fire.

Thus it is an object of the present invention to markedly improve the fire resistance of IBCs having metal support structures.

A further object of the present invention is to provide a steel cage reinforced IBC wherein the steel cage is coated with an intumescent paint or coating such that, when the cage is exposed to fire, the paint or coating swells and chars, producing a low density but coherent ash.

A still further object of the present invention is to provide a self insulating metal support cage for an IBC which prevents the temperature of the cage from increasing to the point where the cage will melt through the inner plastic container.

Further and additional objects will appear from the description, accompanying drawing, and appended claims.

SUMMARY OF THE INVENTION

The present invention is a container for holding flammable liquids comprising an inner container and a protective metal cage. The inner container typically is shaped like a square prism with vertical sides of equal or unequal widths and may have a fillport on its top side and a discharge valve located at or near its bottom. The inner container typically is made of plastic, such as high molecular weight, high density polyethylene. The protective metal cage is coated with an intumescent paint or other intumescent coating. When the intumescent coating is exposed to high temperatures, such as could happen during a warehouse fire, the coating swells and chars, producing an ash that insulates the metal cage, preventing it from heating up to the point where it can melt through the inner container.

DRAWING

FIG. 1 is a perspective view of a composite intermediate bulk container according to the present invention.

DETAILED DESCRIPTION OF THE INVENTION

Figure 1:
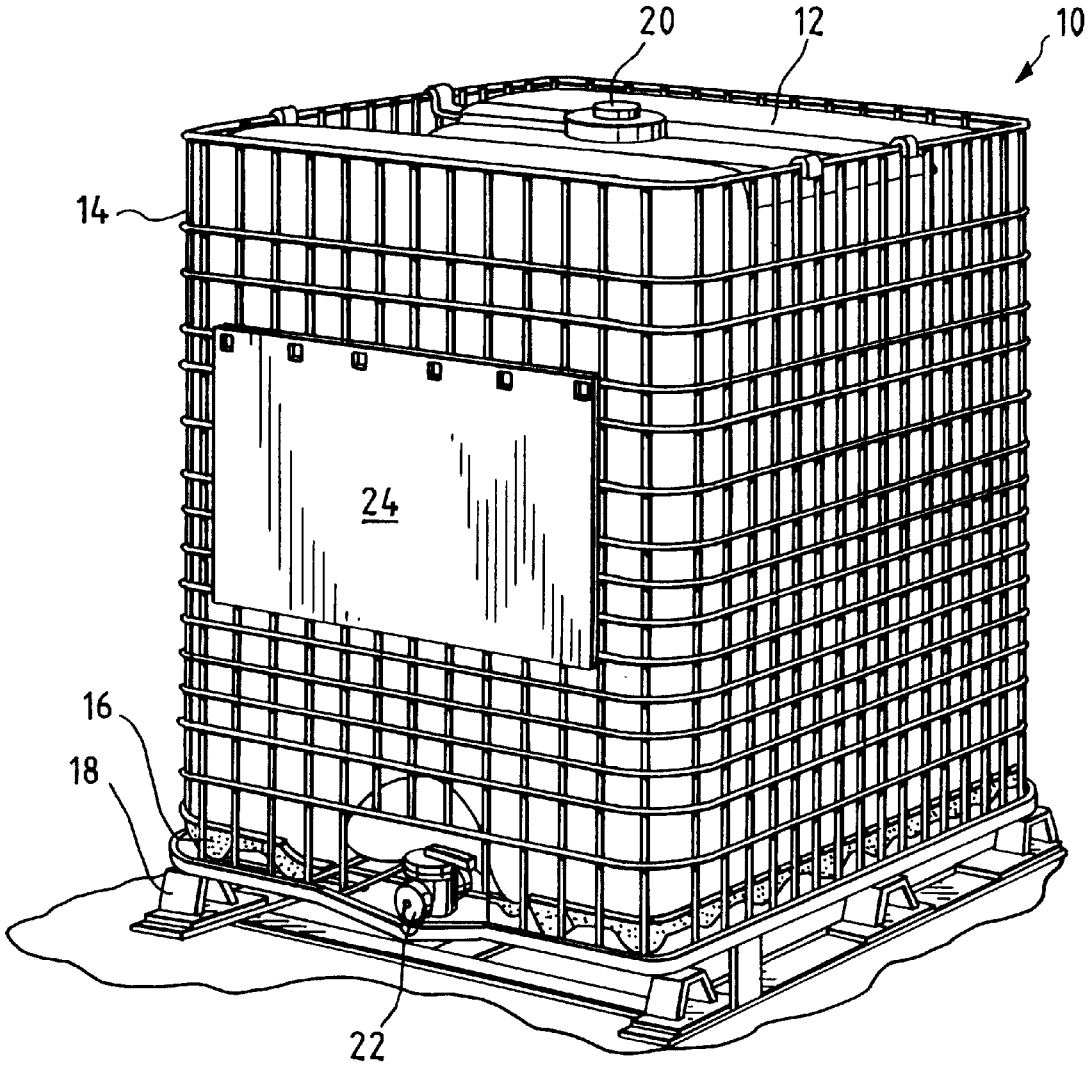

FIG. 1 depicts one embodiment of the present invention, showing a composite intermediate bulk container 10 comprising a square-prism shaped inner container or bottle 12 surrounded on its vertical sides by a metal cage 14 and resting on a molded pulp support pad 16 which in turn rests on a metal pallet 18. The inner container 12 preferably is made from high molecular weight high density polyethylene, but may also be made from other plastic or composite materials. The support pad 16 protects the inner container 12 from puncture on impact, and, in the case of a fire, also prevents direct impingement of flame onto the bottom of the inner container 12 or onto the valve 22.

Composite IBCs may be used in place of conventional drums to reduce filling, dispensing, handling, storage and disposal costs. Liquid contents may be poured in through a fillport 20 located on the top of the inner container 12, and discharged through a valve 22 located near the bottom. A marking plate 24 may be located on the front of the composite IBC 10 for easy product identification.

The welded steel reinforced cage 14, molded pulp support pad 16 and metal pallet 18 are used to provide strength, protection, and ease of transport. Composite IBCs may be stacked three high due to the interlocking feature of the steel cages and pallets.

As has been explained, composite IBCs have not been widely used for holding flammable and combustible liquids because they have not yet been approved by appropriate fire protection agencies and insurance underwriters for use in storing such liquids in "protected" warehouses. This is because when composite IBCs are exposed to fire, the metal cage 14 can heat up and melt the inner container 12 along a generally linear failure line coincident with the line of contact between the rods of the metal cage and the inner polyethylene container. (The container tends not to melt in the areas between the areas of contact with the metal cage, even where flames are impinging on the surface of the container, because the liquid contents of the container act as a heat sink, keeping most of the polyethylene below its melting point and thus preventing melt-through and failure.) If failure of the inner container 12 occurs, the flammable contents may spill out and be exposed to the fire.

My improved composite IBC 10 mitigates this problem because the metal cage 14 is coated with an intumescent paint or other intumescent coating. When the intumescent coating is exposed to high temperatures, it swells and chars, producing a low density but coherent ash. The ash or char provides thermal insulation to the metal cage 14, preventing the temperature of the cage 14 from increasing to the point where the cage will rapidly melt through the inner plastic container 12. Thus the present invention allows the survival of the composite IBC's inner container 12 for a time sufficient for alternative fire protection means to be deployed.

Intumescence is the property of a material to swell or expand when heated. It is known in the art that intumescent coatings may be used as fireproofing agents to protect combustible surfaces. When heated, the intumescent coating forms a layer of non-combustible material, sometimes called char, between the combustible surface and the air.

The active ingredient in many intumescent paints is polyammonium phosphate, which emits a gas at elevated temperatures but at lower-than charring temperatures. When the paint is first exposed to elevated temperatures, the gas swells the paint. Upon further heating, the foamed paint chars, forming a low density but coherent ash which insulates the substrate from further heat.

The typical composition of an intumescent paint includes pigment for color, a resin or other binder to cause the pigment to hold in the dry film and adhere to the substrate, a volatile solvent to allow for easy application of the paint before evaporating from the drying film, an intumescent material such as polyammonium phosphate, and an optional carbonaceous material to enhance the charring effect.

In the present invention the intumescent coating can be applied to the metal cage during the normal composite IBC production process with little increase in production cost. Alternatively, the coating can be applied after production of the composite IBC, as an aftermarket enhancement.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. An improved intermediate bulk container of the type comprising a plastic inner container and a protective structural metal cage surrounding the plastic inner container and comprising a series of bars with openings therebetween, at least some of the bars of the cage being in contact with the plastic inner container, the improvement comprising:

an intumescent coating which coats the bars of the metal cage but does not close the openings therebetween, wherein the intumescent coating, when exposed to fire, expands and forms a char on the bars of the metal cage, thereby preventing the metal cage from melting the plastic inner container along those portion of the metal cage in contact with the plastic inner container.

2. The container of claim 1 wherein the inner container is made from high molecular weight high density polyethylene.

3. The container of claim 1 wherein the protective metal cage is made from steel.

4. The container of claim 1 wherein the inner container has vertical sides and the metal cage surrounds the vertical sides and contacts the inner container.

* * * * *